US005543782A

United States Patent [19]

Rothbaum et al.

[11] Patent Number: 5,543,782

[45] Date of Patent: Aug. 6, 1996

[54] SECURITY DEVICE FOR MERCHANDISE AND THE LIKE

[75] Inventors: Arthur H. Rothbaum, Northport; Richard S. Goldblatt, Kings Park, both of N.Y.

[73] Assignee: Protex International Corp., Bohemia, N.Y.

[21] Appl. No.: 152,520

[22] Filed: Nov. 16, 1993

[51] Int. Cl.[6] ..... G08B 13/14

[52] U.S. Cl. ..... 340/568; 340/691; 439/917

[58] Field of Search ..... 340/571, 568, 340/687, 691, 693; 439/917

[56] References Cited

U.S. PATENT DOCUMENTS

| | | | |
|---|---|---|---|
| 3,127,597 | 3/1964 | Lewin et al. | 340/280 |
| 3,253,270 | 5/1966 | Downer | 340/280 |
| 3,596,265 | 7/1971 | Garland | 340/280 |
| 4,293,852 | 10/1981 | Rogers | 340/568 |
| 4,620,182 | 10/1986 | Keifer | 340/568 |
| 4,746,909 | 5/1988 | Israel et al. | 340/568 |
| 5,066,942 | 11/1991 | Matsuo | 340/568 |
| 5,172,098 | 12/1992 | Leyden et al. | 340/568 |
| 5,317,304 | 5/1994 | Choi | 340/571 |
| 5,341,124 | 8/1994 | Leyden et al. | 340/568 |
| 5,345,219 | 9/1994 | Rogers | 340/568 |

FOREIGN PATENT DOCUMENTS 1730092 3/1992 Australia .

*Primary Examiner*—Thomas Mullen
*Attorney, Agent, or Firm*—Eugene E. Renz, Jr.

[57] ABSTRACT

An electronic security system for monitoring merchandise is provided which sounds an alarm when a change in the sensors or the electrical connections are detected. The system automatically switches from a closed loop continuous current system to a closed loop battery saving pulse system during a power failure. The system also eliminates the need for shunt plugs, splitter boxes, and other extraneous components in favor of a self-contained solid state electronic circuit.

14 Claims, 10 Drawing Sheets

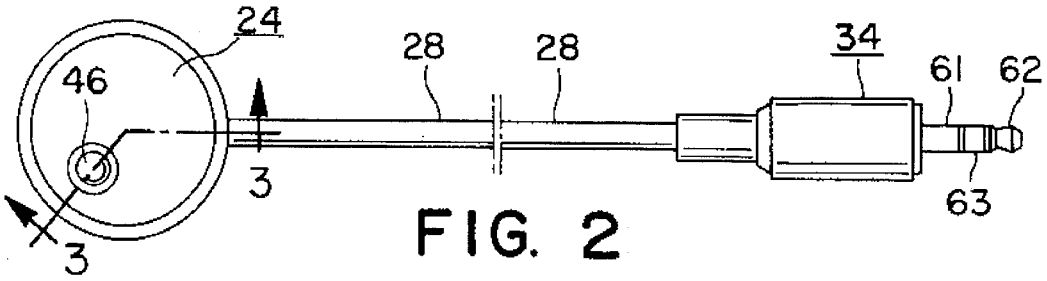
FIG. 2
FIG. 3
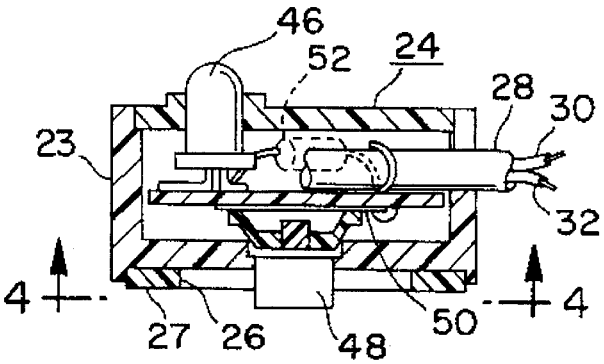
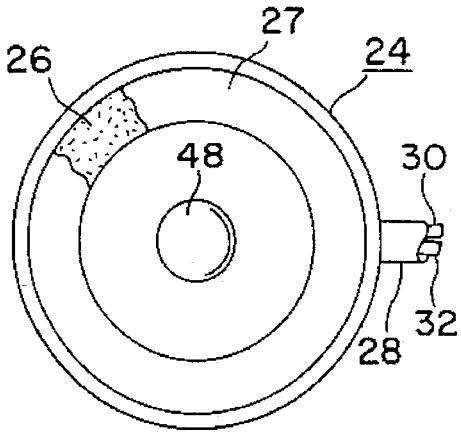
FIG. 4
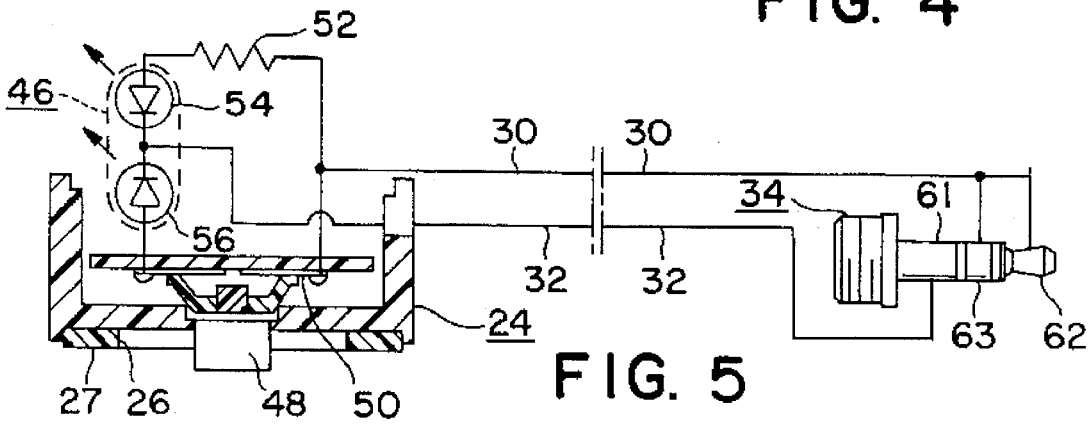
FIG. 5
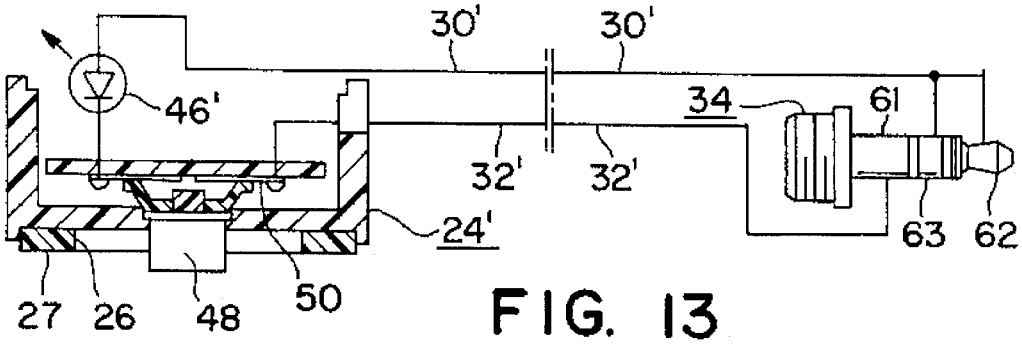
FIG. 13

SECURITY DEVICE FOR MERCHANDISE AND THE LIKE

FIELD OF THE INVENTION

The present invention generally relates to security systems, and more specifically to electronic security systems used in retail stores, offices, hotels and other establishments to prevent the theft of merchandise.

BACKGROUND OF THE INVENTION

Various types of security systems to protect retail goods on display in a store are known throughout the trade. The basic components of the system include a sensor which is attached to each item of merchandise intended to be protected, a switch within the sensor which generates an alarm signal, splitter boxes or similar modular connecting units for receiving signals from the sensors, and an alarm box which is connected to the splitter boxes through various conducting cables and which houses an alarm and related circuitry.

Merchandise security systems can be broadly classified into two groups, closed loop and open loop systems. In a closed loop security system, current constantly flows from the alarm box to the sensor. The sensor switch is in a normally open state, i.e., a non-conducting state. Depressing the actuator of the switch would place the switch in a closed state, i.e., a conducting state. The sensor is attached to the article through the use of two-sided tape or a similar means. With the sensor flush against the item of merchandise, the actuator of the switch is depressed, placing the switch in its closed state, i.e. the contacts of the switch make or are electrically connected. After a sensor is attached to each item of merchandise, the alarm circuit is armed or set. When armed, the alarm box circuitry sends out a continuous current through the splitter boxes and sensor switches; the current then returns to the alarm box circuitry. As long as no cables are cut and the actuator remains depressed, the security system remains in this armed state.

During an unauthorized removal of the sensor, the actuator is distended, which opens the switch contacts and which breaks the closed loop circuit. Similarly, if a cable is cut the continuous current to the sensor is interrupted. The alarm box circuitry detects that the current has been interrupted and an alarm will sound. The alarm notifies store personnel that there has been a security breach.

A typical closed loop alarm system is disclosed in U.S. Pat. No. 5,172,098, issued Dec. 15, 1992 (the '098 patent). This alarm system includes an alarm box, multiple splitter boxes, shunt plugs for the splitter boxes, sensors, light emitting diodes (LEDs) on the sensors, switches in each sensor, and a power supply. The power supply provides power to the alarm circuitry and the LEDs. The LEDs located on the sensors are two-terminal bi-color LEDs. When the sensor is properly affixed to the merchandise, the actuator of the switch is depressed and the current flows from the alarm circuit to the detector circuit in the splitter box, through the connector cables and finally through the sensor switches. This forms a first circuit loop or a switch loop.

The detector circuit determines if the switch is closed and therefore whether the merchandise is secured. When in the armed or secured state, current flows through a second loop (the LED loop) to power the LED a first color, e.g., red. This second loop doubles the number of wires and connections requiring a total of four wires for this alarm system sensor.

The increase in the number of wires and connections increases the costs associated with these alarm systems. In addition, the increased number of loops or circuits, means that there is a greater likelihood of improper installation since inaccurate feedback may be given to the person installing the system. For example, the sensor may be improperly attached to the merchandise, but the LED may indicate an armed condition. This may occur when one loop has been damaged or when there is a faulty connection in one of the loops.

When the sensor is removed from the merchandise, the sensor switch is opened and the detector circuit determines that a security breach has occurred. The detector circuit sends a signal to the alarm circuit activating the alarm and also sends a control signal through the second loop to change the color of the sensor LED to indicate an unsecured state, e.g., green.

The '098 patent's splitter boxes typically have connections for up to six items of merchandise. The splitter boxes can be strung together to increase the number of items secured. When the number of pieces of merchandise needed to be secured is not a multiple of six, shunt plugs are required to be inserted into all open connections, to keep the sensor loop closed.

The assignee of the '098 patent has developed several security systems which operate similar to the '098 patent, for example its Kord Kontrol® strip alarm system. The assignee's variations from the '098 patent have substantially the same drawbacks as the '098 patent.

A drawback of all closed loop security systems is that current must constantly flow. Accordingly, power must be supplied to the sensor switch at all times. This presents a problem during power outages. Also, many stores turn off all power to the retail floor space at night or when the store is closed.

Battery backups have been designed to supply the necessary current; however, the current draw on the batteries is often too great to supply current for extended periods of time. This leaves the merchandise unprotected from unscrupulous security guards and support personnel (janitors, stock boys, etc.). In addition, batteries would need to be checked and replaced on a regular basis, increasing the maintenance of the security system. Recently, the situation has become more acute with the use of light emitting diodes (LEDs) on the splitter boxes and on the sensors. The LEDs add to the current drain making a battery back-up system an even less viable option.

Another drawback to many closed loop security systems is that they require shunt plugs on the splitter box connections which are not connected to merchandise. The shunt plugs form an electrical connection to prevent the alarm from sounding when the system is armed. Shunt plugs increase the cost of the system and are also a source of misconnections if improperly installed. Further, shunt plugs must constantly be installed and removed as the items of merchandise are sold or as stock is replaced. Accordingly, the shunt plugs increase the amount of time store personnel must spend attending to the security system. In addition, if the required shunt plugs are lost or not installed properly the security system is inoperable since the alarm will sound continuously.

An open loop security system operates in a similar fashion to a closed loop system. However, the sensor switch would be normally closed, i.e. when the actuator is distended. When the sensor is properly attached to the merchandise, the actuator is depressed and the circuit is open. If there is a tampering of the sensor switch, the actuator distends, the switch contacts close and current flows through the sensor switch. A circuit is completed when the sensor switch closes, activating the alarm.

In an open loop security system, the alarm does not sound unless a circuit is completed. Normally, the only way to complete the circuit is to remove the sensor from the article. Therefore, an open loop security system may be circumvented by cutting the sensor cable or removing the sensor cable plug from its jack. In this manner, the article may be stolen without the alarm sounding. Since open loop systems are easier to circumvent, they are not as popular as closed loop systems.

In both, closed loop and open loop systems, the use of alarm modules or splitter boxes increases the maintenance of the security system. Extra connections are required to incorporate these splitter boxes; these extra connections are a weak link that can be attacked by a thief. Further, splitter boxes are unsightly to look at, and are a source of misconnections and false alarms.

SUMMARY OF THE INVENTION

It is an object of the instant invention to provide an improved security system to protect merchandise and the like.

The present invention is a fully integrated security device and system to protect articles of merchandise within a retail store. All alarm and detection circuitry and all connections to the sensors are located in one housing, making it an integrated or completely self-contained unit. The instant security device and system includes a plurality of sensors attached to the items which are to be protected. Item cords connect the sensors directly to an alarm circuit. Separate alarm modules or splitter boxes are not required.

The alarm circuit is housed in a single unit or strip and is usually remotely located from the protected items of merchandise. A bi-color LED is associated with each sensor circuit and is located on the housing next to the item cord connector. In its secure or non-alarm state, the LED displays a first color, e.g. green, indicating that the system is armed and the item of merchandise is protected. Upon the unauthorized removal of the sensor, the cutting of the item cable, or upon a similar security breach, the alarm will sound and the LED will change from its first color to a second or alarm color (green to red).

After a security breach, the store personnel goes to the alarm system to turn the alarm off. After viewing the LEDs on the housing, the store personnel can immediately see the alarm color displayed by the housing LED (red), and will be informed of the exact location in which the security breach took place.

Bi-color LEDs may also be placed within the sensor housing to provide a visual warning to a potential thief that the item of merchandise is protected by a security system. The colors of the sensor LEDs may match the colors of the strip LEDs. When the system is armed and the sensor properly attached to the item, the sensor LED indicates a first or secure color (green). Upon the unauthorized removal of the sensor from the item, the sensor LED turns from green to red.

The instant invention is a closed system when drawing power from its AC adapter. However, during a power outage or when the power is turned off in the stores at night, the system switches to an energy conservation mode in which a battery supplies the power. In the energy conservation mode, current does not continuously flow to the sensors but is pulsed. The current is sent through the circuit in microsecond bursts, thus conserving energy. The strip LEDs are turned off during battery operation and are only lit during a security breach, further conserving the battery power. The sensor LEDs will pulsate during the microsecond bursts, which further conserves the battery. The pulsating sensor LEDs are still visible to store personnel.

If there is a security breach during the energy conservation mode, the alarm will sound and the strip LED which corresponds to the sensor which was breached will indicate the alarm color. If the security breach is the unauthorized separation of the sensor from the merchandise, then the sensor LED will also indicate the alarm color.

BRIEF DESCRIPTION OF THE DRAWINGS

Other objects and advantages of the present invention will become apparent from the following detailed description, when taken in conjunction with the accompanying drawings, wherein:

FIG. 2 is a perspective top view of a sensor for hard goods, utilizing a bi-color LED;

FIG. 3 is a cross-sectional view of the sensor of FIG. 2 along lines 3—3;

FIG. 4 is a perspective bottom view of the sensor of FIG. 2;

FIG. 5 is a schematic diagram of the sensor of FIG. 2, shown in cross-section;

FIG. 13 is a cross-sectional view of a sensor for hard goods utilizing a single color LED;

DETAILED DESCRIPTION OF THE PREFERRED EMBODIMENT

Figure 1:
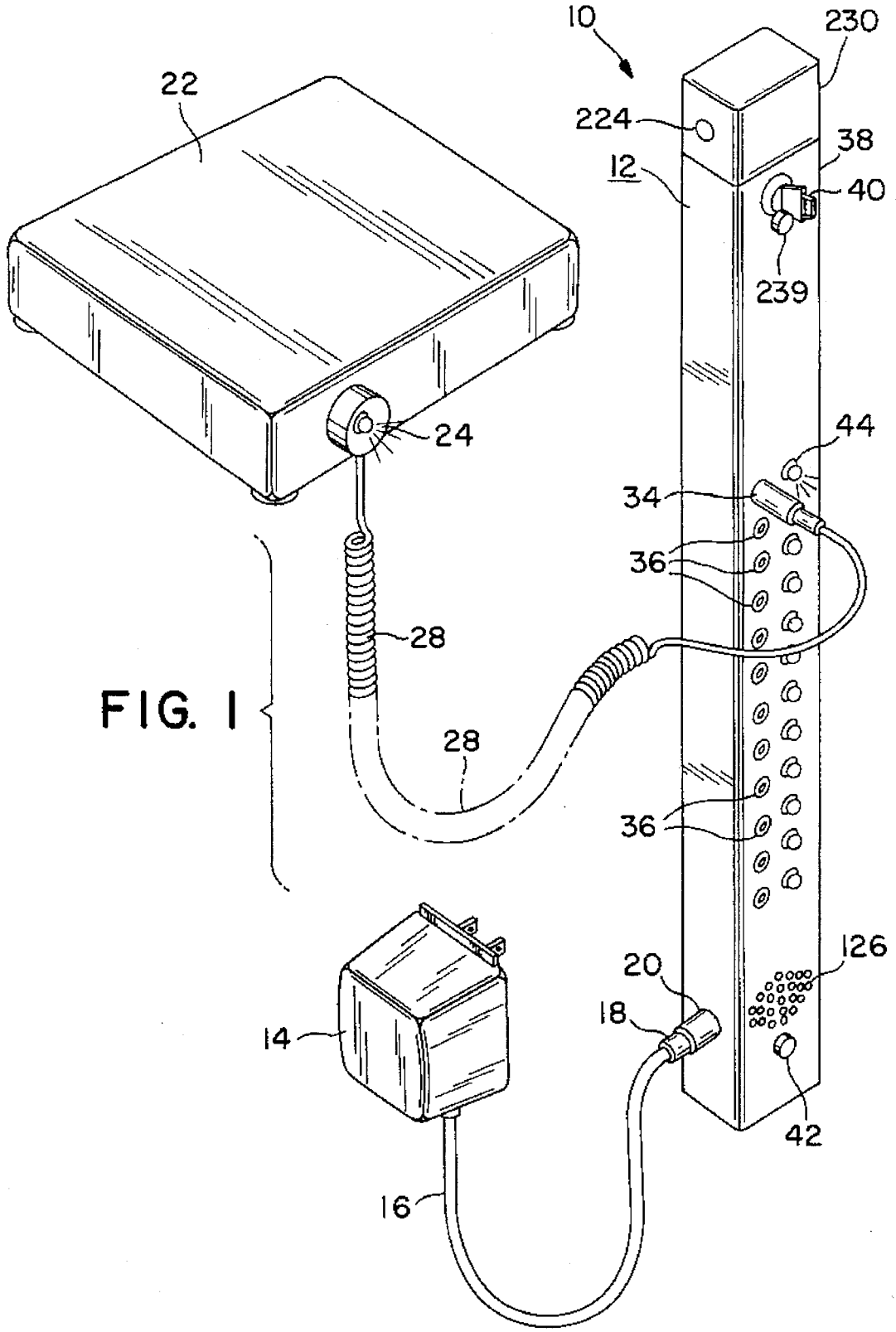
FIG. 1 is a perspective view of the security system according to the present invention.

The security system of the present invention is particularly adapted for use in protecting merchandise displayed in a retail store. Referring now to the drawings, a security system, according to the instant invention, includes at least one sensor along with an alarm circuit; one such security system being designated in its entirety by reference numeral 10.

Referring to FIG. 1, a twelve jack security system 10 is shown which can protect twelve items of merchandise. One skilled in the art could replicate the circuitry to make a security system to protect any number of items. The preferred embodiments envision a twelve or twenty-four jack security system.

A strip or housing 12 contains the majority of the circuitry. This self-contained or integrated approach eliminates the need for splitter boxes. Accordingly, the number of wire connections is reduced.

Under normal operation, strip 12 is mounted in a location remote from the merchandise, and preferably near an AC outlet. Although the strip 12 is shown in a vertical orientation, it may be mounted in any orientation, including horizontally, without affecting its operation.

Power to the security system 10 is supplied by an AC adapter 14. AC voltage is converted by AC adapter 14 to nine volts DC and is supplied to the system circuitry via power cord 16.

Power cord 16 may be hard-wired to the security system. However, for flexibility and maintenance reasons, a two-wire plug 18 is attached to the end of the power cord 16 for connection to the alarm circuit. A jack 20 on the housing 12 receives plug 18. The wires connected to jack 20 carry the voltage to the circuitry.

Whenever plug 18 is inserted into jack 20 and adapter 14 is being supplied AC power from an outlet, power indicator light 42 is lit. If power is interrupted (e.g., plug 18 is removed from jack 20 or there is an AC power failure) power LED 42 is turned off. The power indicator light 42 may be a one color LED, and is preferably a green LED. The illumination of power indicator 42 is independent of the position of key switch 38.

The jack 20 and power LED 42 may be located anywhere on the strip 12. The positions of jack 20 and power LED 42 are dictated by design constraints, the location of the circuitry inside strip 12 or for aesthetic reasons.

Store personnel decide which articles of merchandise 22 are to be protected. In this embodiment, up to twelve items of merchandise 22 may be selected for protection since a twelve-item security system 10 is used. Hard goods, including TV's, VCRs, computers, telephones, etc., are commonly displayed in stores. A variety of sensors may be used to attach to the merchandise to be protected. For purposes of illustration, hard goods sensor 24, as seen in FIGS. 2–4 will be used to describe the operation of the security system. However, one skilled in the art would readily understand that this system would work with any sensor that had a two-state element (off/on); for example clips, conductive loops, and specially adapted computer plugs and RCA-type plugs.

Hard goods sensor 24, including a sensor housing 23, is attached to the article 22 by double-backed tape 26, as seen in FIG. 4, or by a similar means (plastic straps, clamps, etc.). Protective backing 27 is removed from the tape 26 and the sensor 24 is pressed against article 22 depressing actuator 48.

Item cord 28 is of sufficient length to connect the sensor 24 to the alarm circuitry in strip 12. In the preferred embodiment, item cord 28 is coiled to allow for a longer length while minimizing entanglement.

Any connection means can be used to connect the sensor 24 to the security system circuit. In the preferred embodiment, when utilizing three terminal bi-color LEDs 46 on the sensor 24, three-contact sensor plugs 34 are used with two contacts shorted together (see FIGS. 5 and 7). Sensor plugs 34 are illustrated as being straight, however any style of plug may be used including right-angle plugs.

A dual-switch mating jack 36 is mounted in the housing 12. The sensor plugs 34 and its corresponding mating jack 36 are off-the-shelf items.

The security system 10 is activated by a switch means. For increased security, the preferred switch is a key switch 38. Key switch 38 is a double-pole double-throw switch, and switches the security system from a SET-UP mode to the armed or ON mode. Key 40 activates key switch 38 and can be customized for each security system 10. Only authorized personnel should have access to key 40 to prevent the circumvention of the security system.

Figure 6:
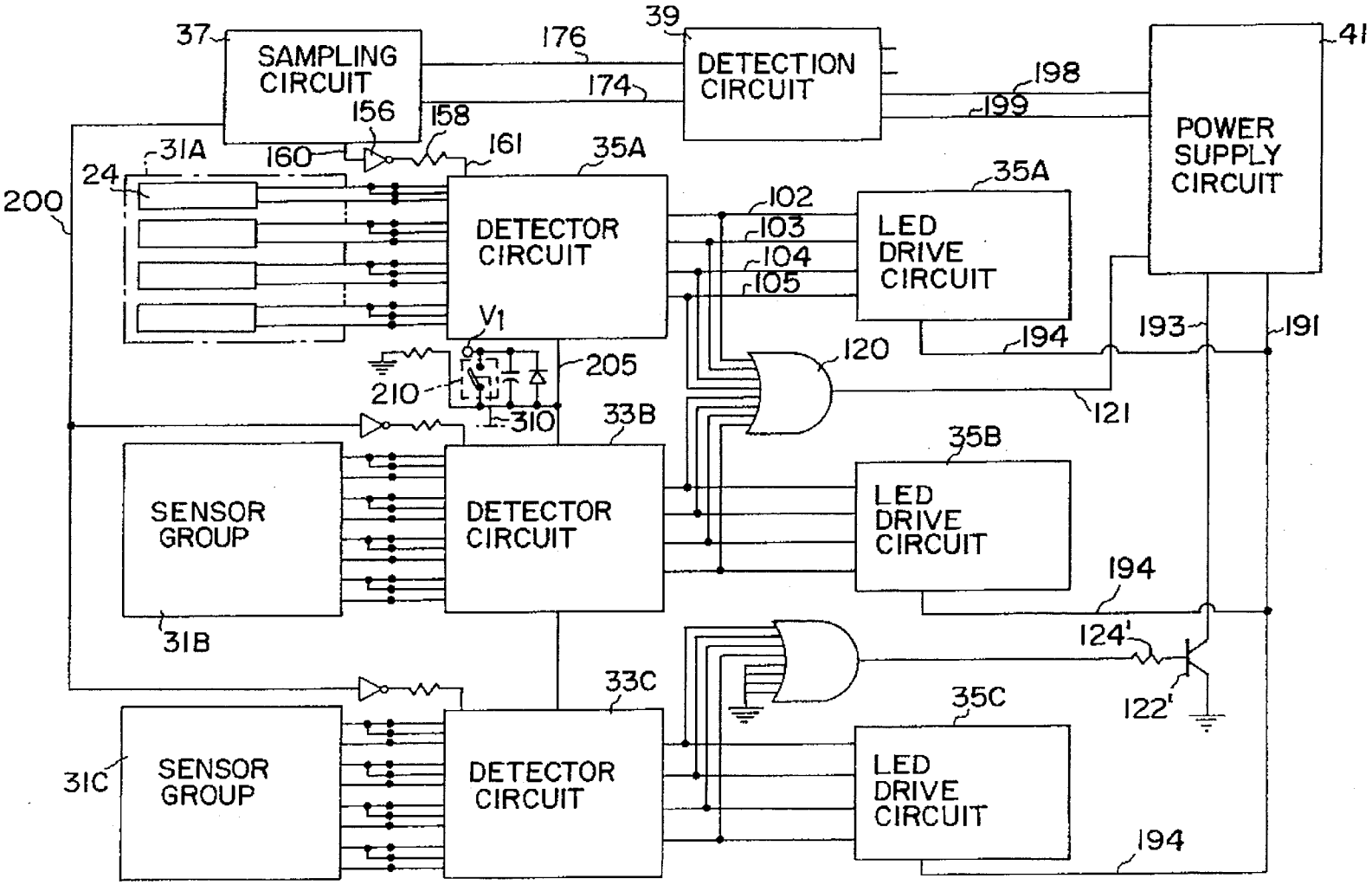
FIG. 6 is a block diagram of the security system according to the present invention.

The basic circuit operation will now be described. FIG. 6 is a block diagram of the security system 10. A single alarm circuit will be described, however one skilled in the art would understand that this circuit can be readily replicated to form a custom security system to protect any number of items of merchandise. In the preferred embodiment, the present security system is designed having either twelve or twenty-four jacks 36 on the strip 12.

Referring to FIG. 3, sensor 24 is shown in cross-section. A single-pole single-throw switch 50 is the principal alarm signal generation means and is secured to the interior of the sensor housing 23. Actuator 48 of switch 50 is biased in a distended position and switch 50 is normally open. The backing 27 of the annular piece of double-sided tape 26 is removed, exposing a security sticky surface. As the sensor 24 is brought into contact with the article 22, the actuator 48 is depressed and sensor switch 50 is closed. The sensor 24 is held in place by the double-sided tape 26 which is sufficiently strong to keep actuator 48 depressed and to prevent the accidental separation of sensor 24 with the article of merchandise 22 when handled by prospective buyers.

Figure 7:
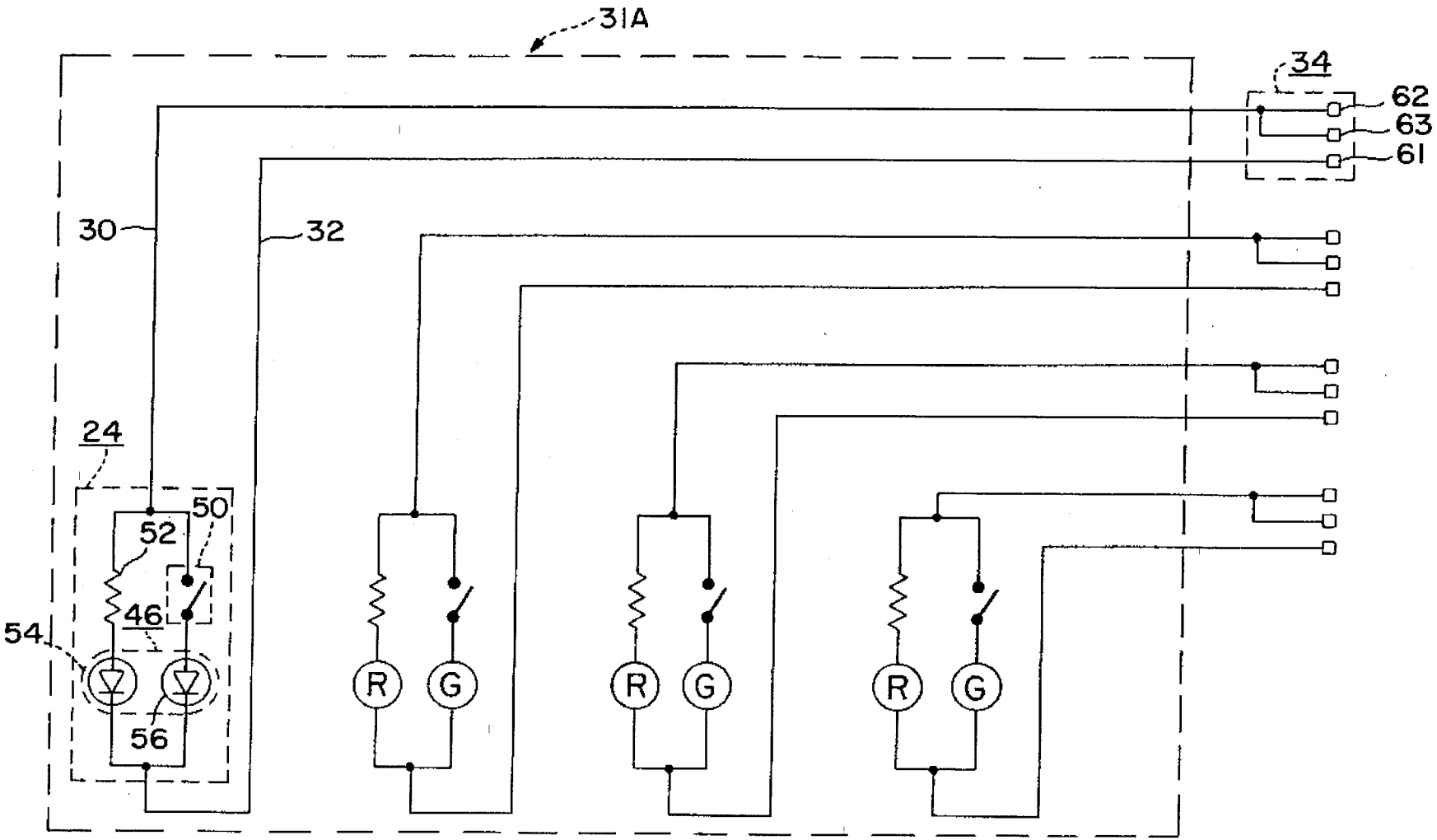
FIG. 7 is a schematic diagram of the sensor circuitry which is a section of the security system indicated by 31A of FIG. 6.
Figure 9:
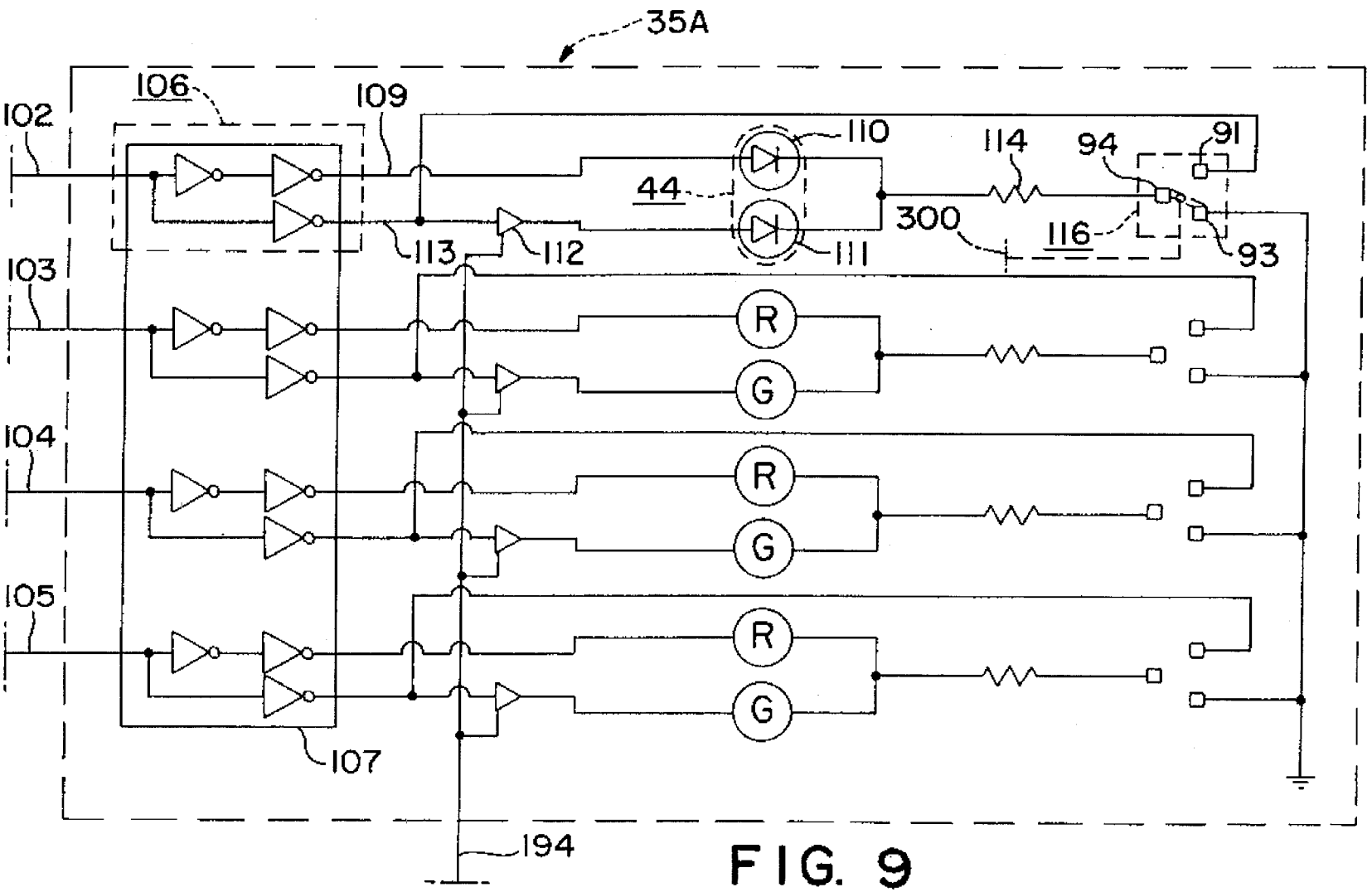
FIG. 9 is a schematic diagram of the strip LED drive circuitry which is a section of the security system indicated by 35A in FIG. 6.

Referring now to FIGS. 5 and 7, when the actuator 48 is depressed, closing switch 50, current flows from the alarm circuit through plug 34, wire 30, switch 50, green LED 56, and wire 32 back to the alarm circuit. The green LED 56 of the bi-colored LED 46 is turned on, as is the corresponding green LED 111 of strip LED 44. (See FIGS. 1 and 9.)

If there is a security breach, for example when there is an unauthorized removal of the sensor 24 from the article 22, the actuator 48 distends opening switch 50. Accordingly, the current flows through wire 30, resistor 52 and the red LED 54 of the bi-colored LED 46, and returns, via wire 32, to the alarm circuit. The value of resistor 52 is determined primarily by the design of the alarm circuit and is typically a one kilohm (KΩ) resistor.

Other sensors may be used with the present security system having an operation similar to sensor 24. The LED 46 is not required, however a two-state element similar to switch 50 is needed.

In FIG. 13, a sensor 24' is shown which is also used to protect hard goods. A two-terminal single color LED 46' is utilized instead of the three terminal bi-color LED 46. One terminal of the single color LED 46' is connected to wire 30', and the remaining terminal is connected to one side of switch 50. The other connector of switch 50 is connected to wire 32'. Plug 34 is connected to wires 30' and 32' in the normal manner.

If sensor 24' is used, the first or non-alarm color may be green; a security breach is indicated when the LED 46' is not illuminated.

In a twelve-item security system, shown in FIG. 6, the sensors are divided into three groups of four sensors each 31A, 31B, 31C for the purpose of discussion. FIG. 7 is a schematic diagram of sensor 31A. The operation of each group of sensors 31A, 31B, 31C is generally identical to the other groups, however, as explained previously, different sensors may be used. Also, twelve sensors are not required for the proper operation of the security system. It may be operated with one sensor plug 34 inserted into a sensor jack 36.

Wires 30 and 32 are connected to the alarm circuit through sensor plug 34. Plug 34 is a three conductor plug having two of its conductors 62,63 shorted together. Wire 30 is connected to the shorted conductors 62,63. Wire 32 is connected to the remaining conductor 61 of plug 34. Wires 30,32 are connected to plug 34 in the normal manner, however, FIG. 5 provides a visual of the connections showing the three separate conductive areas of plug 34.

Figure 8:
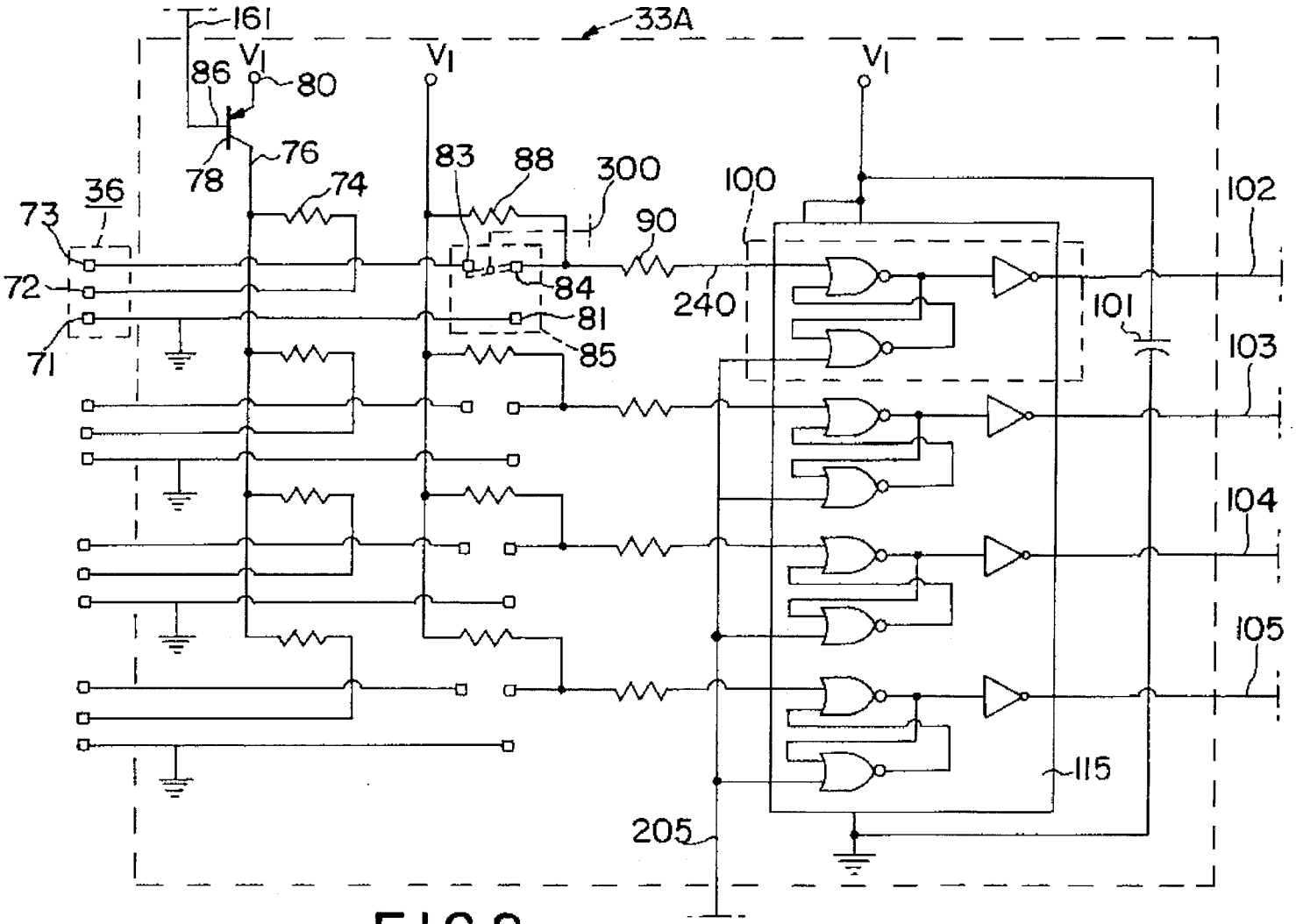
FIG. 8 is a schematic diagram of the detector circuitry which is a section of the security system indicated by 33A in FIG. 6.

Detector and latch circuits 33A, 33B and 33C of a twelve item security system are shown in FIG. 6. The circuitry and operation of each detector circuit 33A, 33B, 33C is substantially identical. The schematic diagram of detector circuit 33A is shown in FIG. 8. Jack 36 having conductors 71, 72, 73 is shown. When plug 34 is inserted into jack 36, conductor 61 makes electrical contact with conductor 71, conductor 62 makes contact with conductor 72 and conductor 63 makes contact with conductor 73. Conductor 71 is grounded and is also connected to contact 81. Conductor 73 is connected to contact 83. Connector 72 is connected to resistor 74, typically a 560 ohm resistor; the other end of resistor 74 is connected to the collector terminal 76 of transistor 78. The emitter terminal 80 is attached to the supply voltage V1 which is nominally nine volts DC. The base terminal 86 of transistor 78 is connected so that transistor 78 is normally ON. Transistor 78 is a PNP transistor, for example a 2N2907. The voltage at the collector terminal 76 is designated V2 and is nominally nine volts.

With switch 50 closed, i.e. sensor 24 properly attached to the merchandise 22, and with the sensor plug 34 plugged into strip jack 36, the voltage appearing at conductors 72, 73, with respect to ground, is approximately 2 to 2.2 volts, which is the forward voltage drop of the green LED 56 of the sensor 24. Note that when using the hard goods sensor 24, the voltage at conductor 72 is equal to the voltage at conductor 73 since plug conductors 62 and 63 are shorted at sensor plug 34. The voltage to sensor LEDs 54, 56 is provided through resistor 74. Terminal 73 of jack 36 is connected to the junction of pull-up resistor 88 and resistor 90. Resistor 88 is typically a 6.2 megaohm (MΩ) resistor and resistor 90 is a 10 kilohm (KΩ) resistor.

The connection of terminal 73 with resistors 88 and 90 is made through contacts 83 and 84 of a double-pole double-throw slide switch 85. Slide switch 85 is integrated into jack 36 and co-acts with jack 36 when plug 34 is inserted into and removed from jack 36. Contact 84 is the common contact. When the sensor plug 34 is inserted into the jack 36, the slide switch contacts 83 and 84 are shorted together and contacts 81 and 84 are open. When sensor plug 34 is removed from jack 36, the slide switch contacts 81 and 84 are shorted together and contacts 84 and 83 are open.

Resistor 88 provides a pull-up voltage V1 (9 volts in this embodiment) to the input of the cross-coupled NOR set/reset latch 100. Resistor 90 provides input protection to the set input 240 of latch 100. Various set/reset latches can be used; for example CD4043B is a common integrated circuit chip 115 which contains four set/reset latches 100. Chip 115 is connected in a normal manner including a filtering capacitor 101.

When the voltage appearing at the input to the latch 100 is less than ⅓ of the V1 supply voltage (a non-alarm condition), the output of the latch 100 will be low. If the voltage appearing at the input to latch 100 is greater than ⅓ of the V1 supply voltage (a security breach), the output of the latch 100 will go high.

The output of the latch 100 drives the input of a true/complement buffer 106 via line 102. (See FIGS. 8 and 9.) Buffer 106 is a typical buffer and may be found for example on semiconductor chip CD4041UB designated by reference numeral 107.

The latch circuitry 100 ensures that the removal and reinsertion of plug 34, or the removal and reapplication of sensor 24, will not reset the alarm circuitry. Accordingly, once a breach of security condition is detected, the alarm horn 126 will sound Until key switch 38 is turned from the 0N position to the SET position. The latching circuits also prevent tampering of the strip 12. If a new plug 34 or a foreign object is inserted into jack 36, an alarm will be initiated.

The LED drive circuitry is designated by reference numerals 35A, 35B and 35C. The circuitry and operation of each module 35A, 35B and 35C is substantially identical. Buffer 106 drives the bi-colored strip LED 44. The true output 109 of buffer 106 drives the anode of the red LED 110 of bi-colored strip LED 44; the complement output 113 of buffer 106, drives the anode of the green LED 111 of the strip LED 44 through a tri-state non-inverting buffer 112. When the output of the latch 100 is low (a secure or non-alarm condition), the complement output 113 will be high, which forces the output of the tri-state buffer 112 to be high. This high voltage will forward bias the green LED 111 on the strip causing it to light. The true output 109 of the buffer 106 will be low thereby reverse biasing the red LED 110 on the strip, keeping the red LED 110 off.

The tri-state non-inverting buffer 112 may be part of a common integrated circuit chip CD4503. In a twelve-item security system, two CD4503 chips will be needed.

The cathodes of the red LED 110 and the green LED 111 of the bi-color strip LED 44 are connected together and attached to resistor 114. Resistor 114 limits the current through the bi-colored strip LED 44 and is typically 1 KΩ. The other end of resistor 114 is connected to the common terminal 94 of a second slide switch 116 contained within strip jack 36. Slide switch 116 is activated upon the insertion and removal of sensor plug 34 from jack 36. The purpose of slide switch 116 is to provide the proper bias voltages for strip LED 44.

The connections between terminals 91, 93 and 94 are similar to terminals 81, 83 and 84. These terminals 91, 93 and 94 are part of a double-pole double-throw slide switch 116. Terminal 94 is the common terminal. Connections are made between the common terminal 94 and the connecting terminals 91 and 93 depending on whether a plug 34 is inserted into jack 36. When plug 34 is inserted into jack 36, terminal 94 is shorted to terminal 93. Terminal 93 is connected to ground. When plug 34 is removed from jack 36, terminal 94 is shorted to terminal 91. Terminal 91 is connected to the complement output 113 of the true/complement buffer 106.

It should be noted that both slide switches 85 and 116 are integral to jack 36. Slide switches 85 and 116 are break-before-make switches. The slide switches 85,116 are activated with the insertion and removal of plug 34. When no plug 34 is inserted into jack 36, the input 240 of latch 100 is grounded because common terminal 84 is connected to terminal 81. Since input 240 is less than ⅓ of the V1 supply voltage, the output. 102 of latch 100 remains low. Therefore, whenever jacks 36 are not being used (i.e., when less than twelve items of merchandise are being protected) shunt plugs or jumpers do not have to be inserted into the unused jacks 36.

The output 102 of latch 100 is also connected to an eight input. OR gate 120 as shown in FIG. 6. OR gate 120 may be integrated circuit chip CD4078. The output 121 of OR gate 120, drives transistor 122 through resistor 124. (See FIG. 12). Transistor 122 is an NPN transistor, e.g. 2N2222 transistor. Resistor 124 is nominally a 2 KΩ resistor. The emitter of transistor 122 is connected to ground while the collector is connected to the negative side of horn 126 or alarm means 126. When there is a non-alarm;condition, all of the eight inputs of OR gate 120 are low. The output of OR gate 120 will also be low, and transistor 122 is off, keeping horn 126 off. During a security breach, the input of latch 100 will go to a voltage greater then ⅔ of the V1 supply voltage. This will set the latch 100 and the output 102 of the latch 100 will go high. This high voltage will cause the true output 109 of the true complement buffer 106 to go high which will forward bias the red LED 110. The complement output 113 of the buffer will go low which in turn reverse biases the green LED 111. The result will be that the green LED 111 will go off and red LED 110 will go on. The high output of the latch 100 will cause the output of the OR gate 120 to go high which turns on transistor 122 causing the horn 126 to sound.

Figure 12:
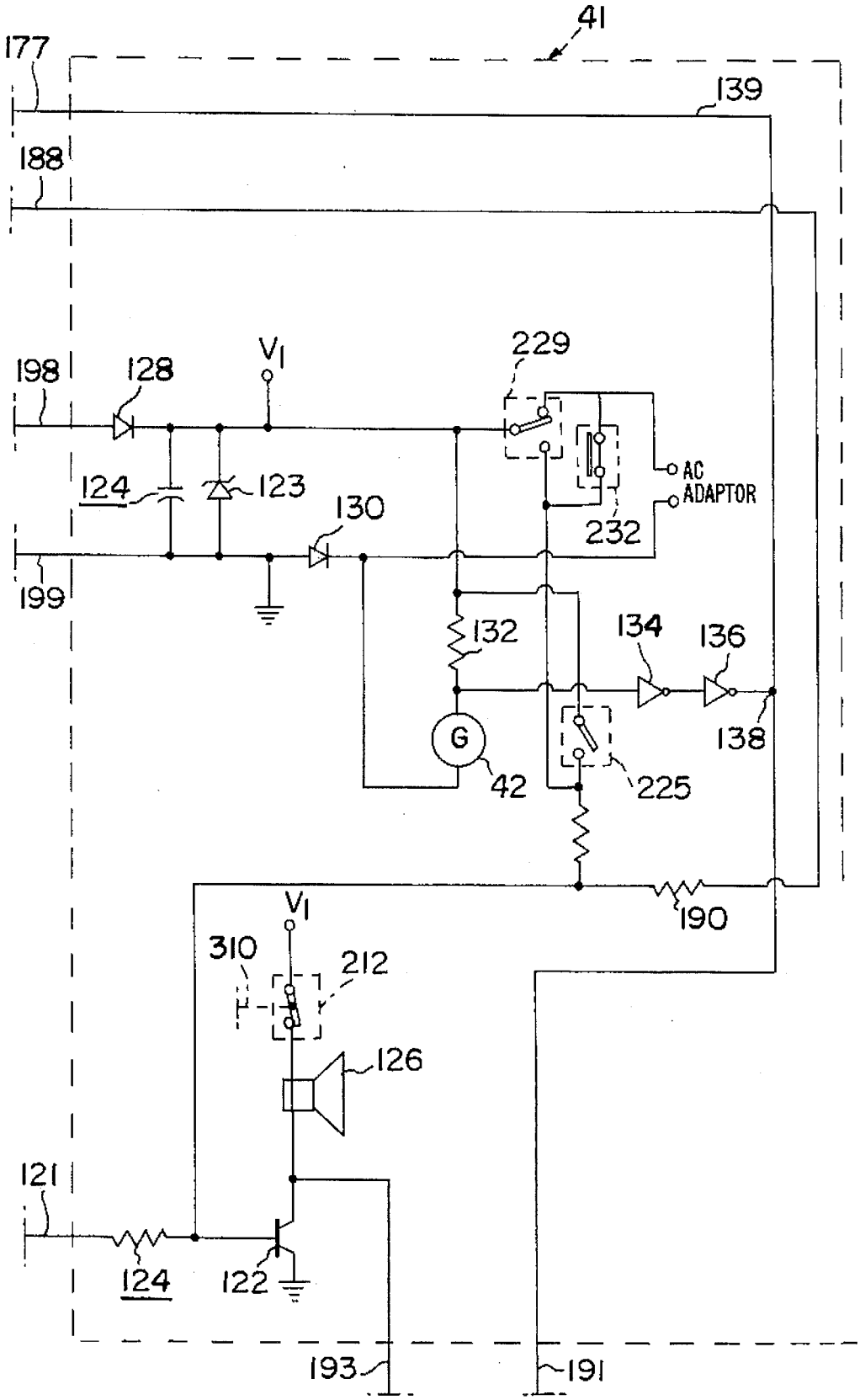
FIG. 12 is a schematic diagram of the alarm circuitry which is a section of the security system indicated by 41 in FIG. 6.

The power for this circuit is provided by a nine volt AC adapter 14. The power supply circuit 41 consists of zener diode 123 as shown in FIG. 12, which is used to clamp voltage transients and thereby protect the rest of the circuit components. Capacitor 124 is used to filter the supply voltage.

In addition, green LED 42 on the strip lights when the AC adapter is providing power to the circuit. Resistor 132, in series with the LED 42, limits the current through LED 42. The voltage across LED 42 will be approximately two volts with respect to the negative side of the AC adapter. The voltage between the anode of the green LED 42 and the circuit ground will be approximately 1.4 volts. The anode of the LED is connected to the input of a Schmitt trigger inverter 134 which drives a second Schmitt trigger 136. The output of Schmitt trigger 136 provides a "loss of AC power" signal to the rest of the circuit via control line 139.

Figure 11:
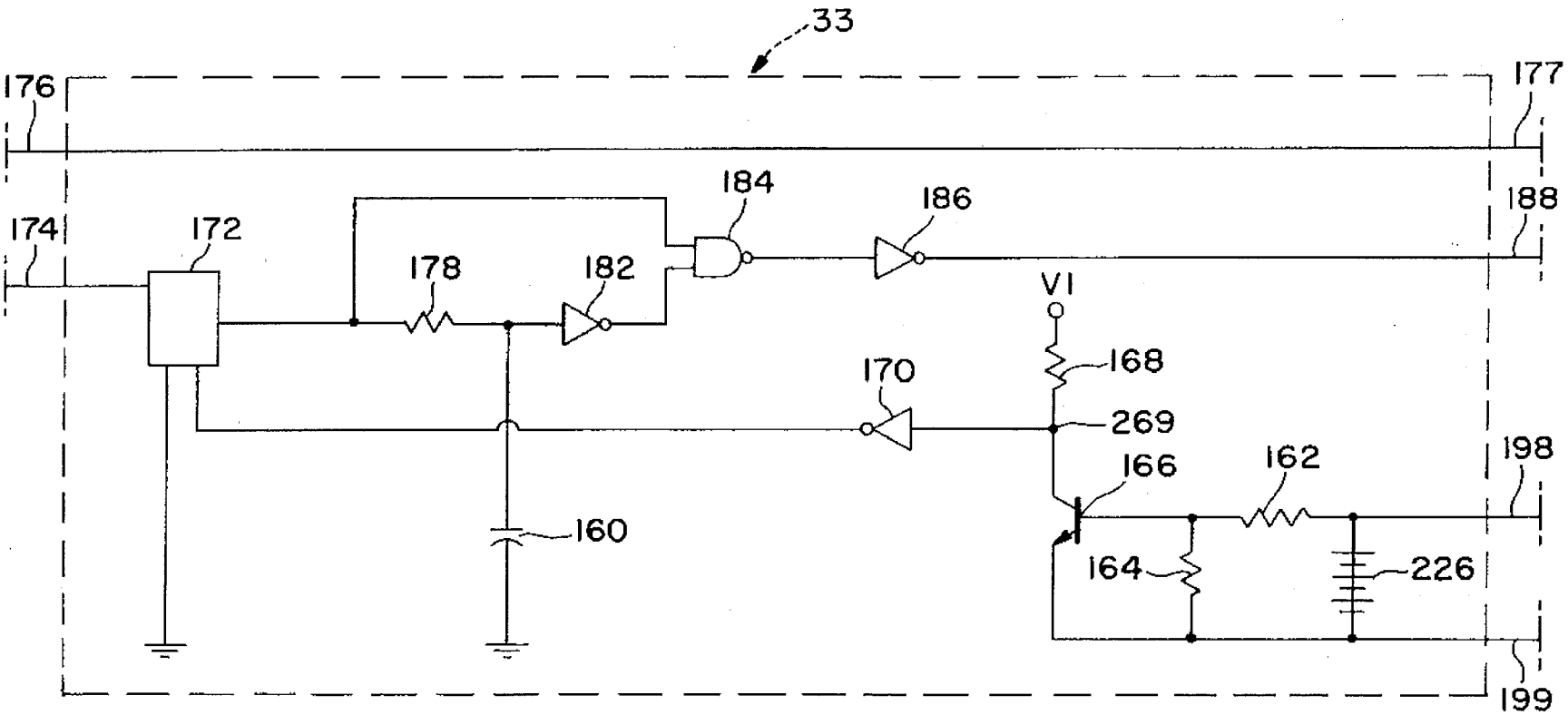
FIG. 11 is a schematic diagram of the low battery detect circuitry which is a section of the security system indicated by 39 in FIG. 6.

The power supply back-up or energy conservation means including inverters 134 and 136 feeding line 139 as shown below is incorporated into the circuit by including a 9 volt battery 226 as shown in FIG. 11. In the event that either the AC adapter was pulled out of its outlet or the AC power main is turned off, the battery 226 provides the necessary power to keep the security system in its armed state. A simple recharging circuit may be incorporated into the back-up supply, however the preferred embodiment does not utilize a rechargeable battery and circuit.

The battery 226 is isolated from the AC adapter by diodes 128 and 130 which functions as a deactivating circuit means as described. When the AC main power is lost, the voltage at the anode of the AC indicator LED 42 becomes equal to the nine volt supply line which is provided by battery 226 via line 198. The green LED 42 will go off and the voltage at its anode will go high. This causes the output of the inverter 134 to go low; this, in turn, forces the output 138 of the second inverter 136 to go high. The output 138 of the second inverter 136 is connected to the tri-state enable pins of the tri-state non-inverting buffer 112, via lines 191 and 194. Inverter 136 also drives one input of a two-input NAND gate 140 to function as a pulsing circuit means, via line 139, which enables the current to pulse through resistors 74 which in turn pulses the green LED on the sensor 24.

When the AC power control line 139 goes high, the alarm circuit goes into its pulsing or low power mode and energy is conserved via the above described energy conservation means. During this low power mode, the tri-state buffers 112 which drive the green LEDs 111, will go to a tri-state condition, thereby turning off all the green LEDs 111 on the strip. The circuit changes from providing a continuous voltage to resistor 74 to a pulsing mode in which power is applied to resistor 74 for approximately 100 microseconds, once every 400 milliseconds.

When AC power is lost and an alarm condition is not present, all LEDs 44, 42 on the housing will be off; all sensor LEDs 46 will be pulsing and are visible. Loss of AC power initiates the pulsing mode. All sensors 24 which require the use of resistor 74 will be sampled for 100 microseconds once every 400 milliseconds; and all sensors which require resistor 88 will be continuously monitored. When an alarm condition occurs, i.e., either by removing sensor plug 34 from jack 36, by cutting sensor cable 28, or by removing the sensor 24 from article 22, the alarm horn 126 will sound and the red LED 110 on the strip, which corresponds to the sensor which has been breached, will light. All other LEDs will remain off.

By turning off LED 42 and the strip LEDs 44, and pulsing the current to the sensors 24, energy is conserved, prolonging the life of the battery 226.

Figure 10:
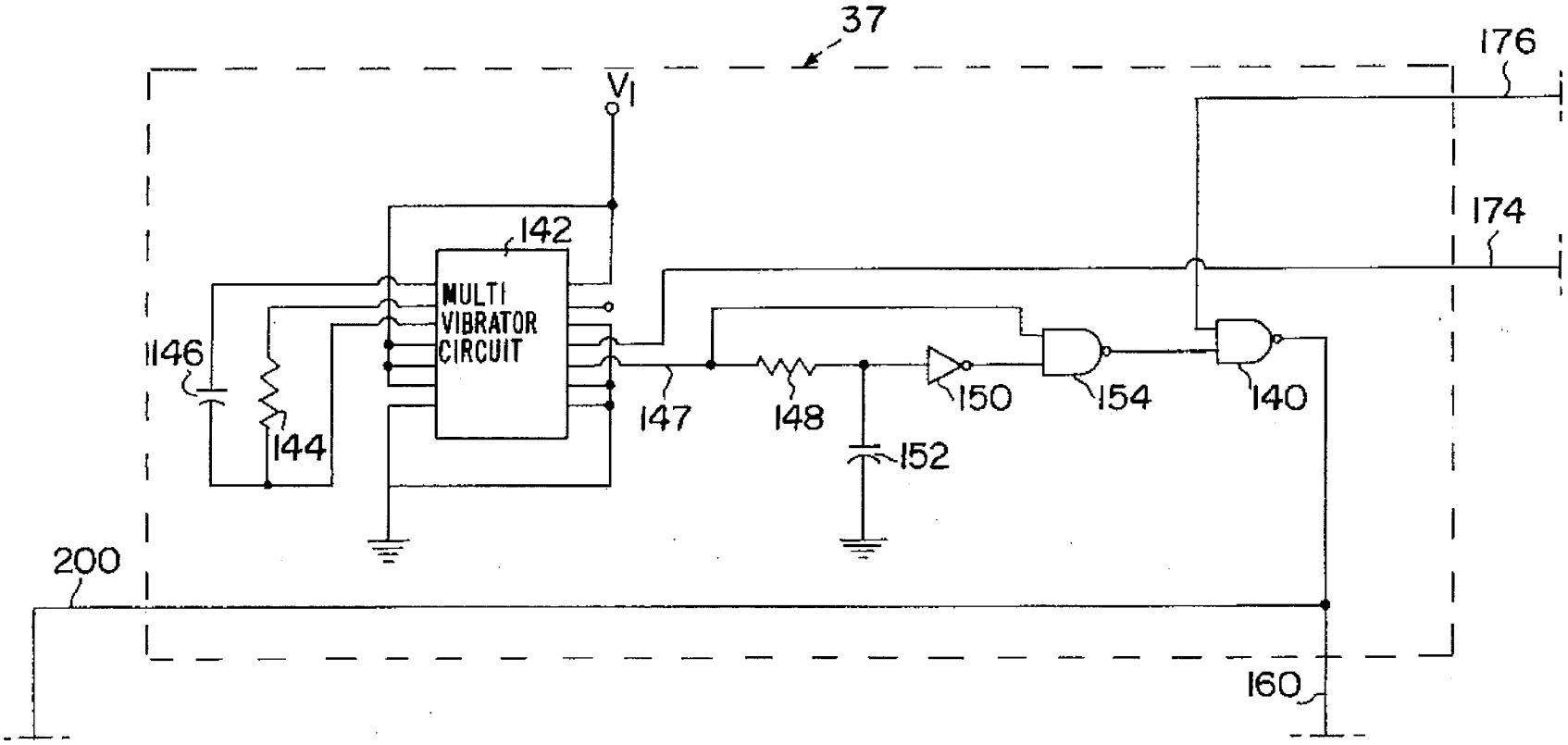
FIG. 10 is a schematic diagram of the sampling circuitry which is a section of the security system indicated by 37 in FIG. 6.

Referring now to FIG. 10, the sampling circuit 37 will be described. An astable multi-vibrator integrated circuit 142 generates a square wave. Resistor 144 and capacitor 146 are designed so that the square wave has a period of approximately 400 milliseconds. The output of multi-vibrator 142 is connected to resistor 148, via line 147, which in turn is connected in series to the input of Schmitt trigger inverter 150. Capacitor 152 is connected between the input of the Schmitt trigger 150 and ground. Resistor 148 and capacitor 152 are designed to form a delay of the square wave of approximately 100 microseconds.

A pulse of approximately 100 microseconds with a period of approximately 400 milliseconds is formed by "ANDing" the output of the oscillator 142 with the output of the Schmitt trigger inverter 150 using a two input NAND gate 154. The output of NAND gate 154 drives the second input of NAND gate 140. When the loss of AC power control line 139 is high, a 100 microsecond pulse appears at the output of NAND gate 140. This pulse is used to drive the input of inverter 156, via line 160, whose output drives resistor 158 which in turn drives transistor 78 all of which functions as a drive means from oscillator 142 as described.

This security system 10 also incorporates a low battery detect circuit in order to provide an indication that the battery 226 is providing only the minimum amount of power to allow the circuit to operate effectively. The indication is a beeping or chirping of the horn 126. Resistors 162 and 164

(FIG. 11) are chosen to detect a low battery condition when the battery voltage is less than 7.5 volts. Typically, resistor 162 is 6.2 MΩ while resistor 164 is approximately 470 KΩ. Accordingly, when the horn 126 chirps, the battery should be replaced. The horn 126 will also beep or chirp if no battery is installed.

The detection circuit 39, as seen in FIG. 11, includes resistor 162 connected to the positive terminal of battery 226. This divides the voltage of the nine volt battery 226. Resistor 162 is also connected to resistor 164 and to the base of transistor 166. The other end of resistor 164 is connected to the negative terminal of battery 226. Resistor 168 is connected between the collector of the transistor 166 and the supply voltage V1.

When the voltage of battery 226 is below the low battery threshold, the voltage at the base of the transistor 166 will be too low to forward bias the base emitter junction of the transistor 166. Transistor 166 will be turned off and its collector will be pulled high through the resistor 168. The output of the Schmitt trigger 170 will go low. This enables the divide-by-64 integrated circuit 172.

The input to divider 172 is a 400 millisecond clock which is provided by the oscillator 142 of the sampling circuit. The output of the divider 172 drives an RC delay network consisting of resistor 178 and capacitor 180. Schmitt trigger 182 is connected to the junction of resistor 178 and capacitor 180. The output of invertor 182 provides a signal which is delayed from the output of the divider 172 by approximately 400 milliseconds. The output of divider 172 and the delayed output from the Schmitt trigger 182 are input to NAND gate 184 producing a negative going pulse for the duration of approximately 400 milliseconds and a repetition rate of approximately 30 seconds. The signal is then inverted by an invertor 186 to produce a positive going pulse which drives resistor 190 as seen in FIG. 12.

The other side of resistor 190 is connected to transistor 122. Transistor 122, as mentioned previously, drives the alarm horn 126. The effect of the circuit is to "beep" the alarm horn 126 once every thirty seconds when the battery voltage falls below the low battery threshold. This beeping will alert store personnel that the battery must be changed or installed.

When the battery voltage is above the low battery threshold, the voltage at the base of transistor 166 will be high enough to forward bias the base-emitter junction of the transistor 166. The transistor 166 will be turned on and the collector voltage will be low. The junction 269 of the collector of transistor 166 and resistor 168 are connected to the input of a Schmitt trigger inverter 170. With the collector voltage low, the output of the inverter 170 will be high. The signal is used to reset a divide-by-sixty-four counter integrated circuit 172 which is used to provide a clock with a period of approximately 30 seconds.

Key switch 38 is actually two single-pole single-throw switches; switch 210 (in FIG. 6) and switch 212 (in FIG. 12) are simultaneously activated when key 40 is turned. The relationship between switch 210 and switch 212 is indicated by reference numeral 310. During the set-up mode, switch 210 is closed resetting latches 100 on chip 115; switch 212 is open disabling the alarm horn 126. Initially, all LEDs 44 on the strip which has a plug 34 inserted into a corresponding jack 36 will turn red; similarly, the sensor LEDs 46 will also turn red. After the sensors 24 are properly installed on the merchandise 22, the sensor LED 46 will turn green and the corresponding strip LED 44 will also turn green. During the set-up mode, the store personnel should not turn the key switch 38 to the ON position until all LEDs are green which indicates that all cables 28 are plugged into their corresponding jacks and all sensors 24 are properly attached to the protected merchandise 22.

When key switch 38 is switched to the ON position, switch 210 opens while switch 212 simultaneously closes. The set/reset latch 100 can now latch the strip LEDs 44 during a security breach. Also, horn 126 can now be activated and will sound if there is a security breach.

As can be seen in FIG. 12, tamper switch 225 is normally open. The tamper switch is activated by the battery compartment screw 224 as can be seen in FIG. 1. If an unauthorized person attempts to tamper with the battery 226, by opening the battery compartment cover 220, they must loosen screw 224. As screw 224 is removed, tension on the activator of switch 225 is moved thus closing switch 225. When switch 225 closes, transistor 122 is turned on thus activating horn 126. Accordingly, this will draw the attention of the store personnel and will deter a thief from tampering with the back-up power supply circuit.

Alternative methods of deterring the tampering of the battery compartment are available. For example, a tamper screw may be used to secure battery compartment cover 220, in which the head of the tamper screw is specifically designed to allow only a particular tool to be inserted to remove the screw.

Switch 229 is shown in FIGS. 1 and 12. In order to insure that the battery is functioning properly, switch 229 may be depressed, thereby testing the horn 126 and battery 226.

Slide switch 232 is a double-pole double-throw switch contained within jack 20 and is similar to switches 85 and 116. Switch 232 is activated by the insertion and removal of plug 18 within jack 20. Switch 232 is normally closed when no jack is inserted into plug 20. However, when the AC adapter plug 18 is inserted into jack 20, switch 232 is open. When the system is on, an unauthorized tampering of the AC adaptor plug 18, will sound the horn 126 notifying store personnel.

Figure 14:
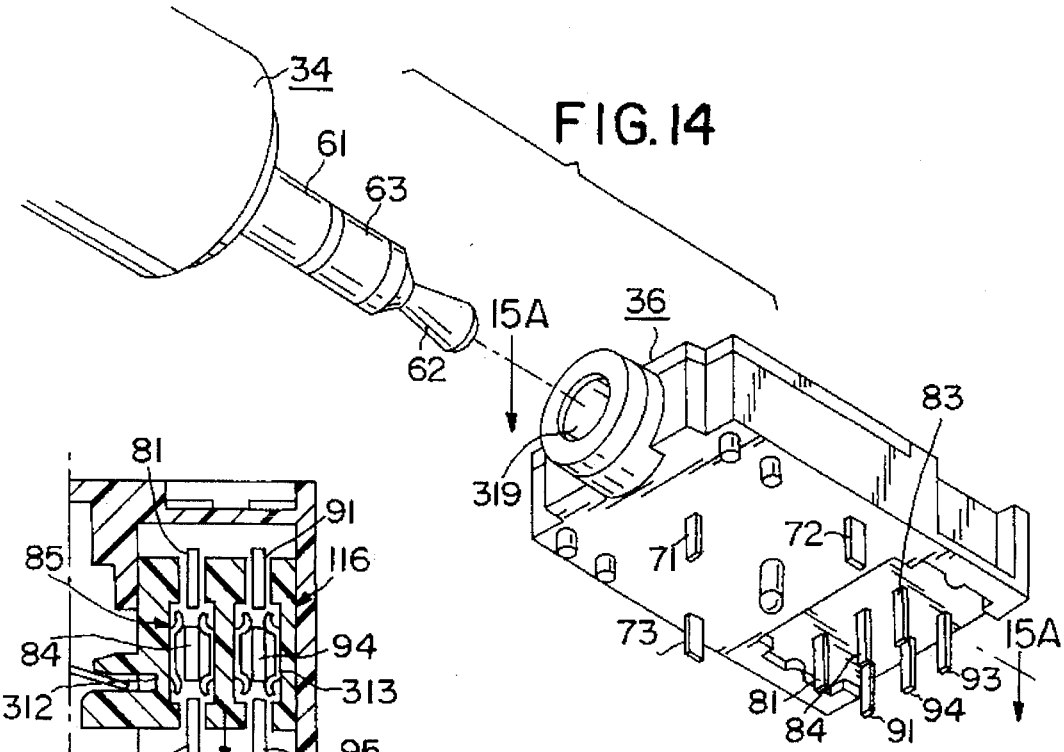
FIG. 14 is a bottom plan view of a plug and a jack having two slider switches which are activated upon the insertion and removal of the plug.

The operation of the slider switches 85,116 inside jack 36 will now be described. Referring to FIG. 14, jack 36 has an opening 319 to allow the insertion of plug 34. Contacts 71, 72, 73 make an electrical connection to contacts 61, 62, 63, respectively, when the plug 34 is fully inserted into jack 36.

Figure 15C:
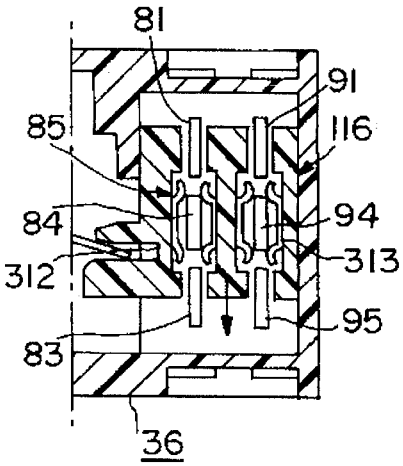
FIG. 15C is an enlarged cross-sectional view of the slider switches of the jack shown in FIG. 15A, when the slider switches are in their intermediate position.
Figure 15A:
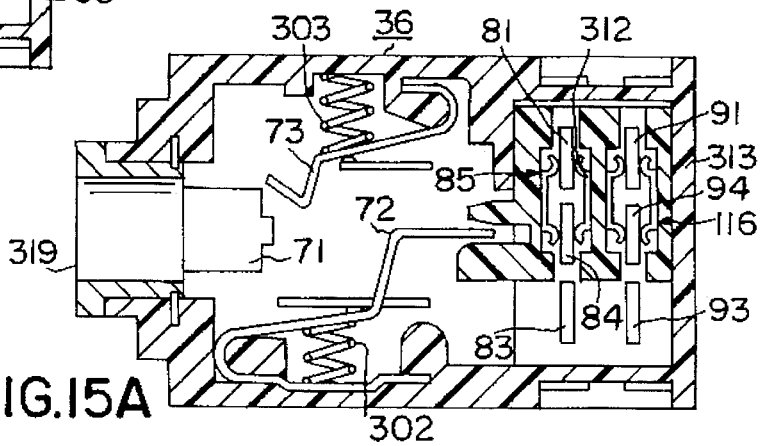
FIG. 15A is a cross-sectional view of the jack of FIG. 14 along lines 15A—15A.
Figure 15B:
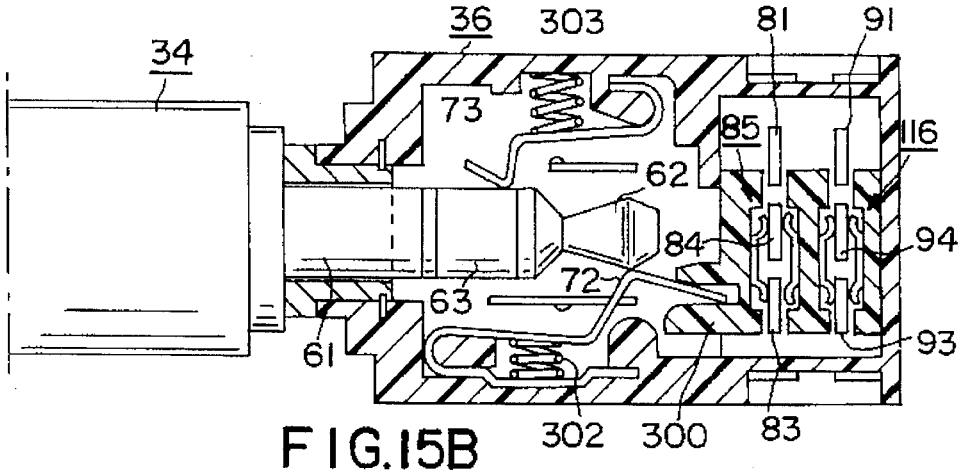
FIG. 15B is a cross-sectional view of the jack of FIG. 14 along lines 15A—15A when the plug is fully inserted into the jack.

As can be seen in FIGS. 15A and 15B, which are cross-sectional top views of the jack 36, contact 71 is stationary. Contact 73 is biased by spring 303 to ensure proper contact with contact 63 of plug 34. Contact 72 is biased by spring 302, to ensure that it touches contact 62. As plug 34 is inserted into jack 36, contact 72 is depressed which slides an insulating bar 300. The metal arms 312 and 313 which are the throws of the double-pole double-throw slide switches 85 and 116 respectively, coact with the insulating bar 300.

As seen in FIG. 15C, metal arms 312,313 slide downward when plug 34 is inserted into jack 36, breaking the connection between contacts 84 and 81 of slide switch 85, and contacts 94 and 91 of slide switch 116. In the intermediate position, common contacts 84 and 94 do not make with any other contacts. Accordingly, switches 85 and 116 are break-before-make switches. When the plug 34 is removed, metal arms 312 and 313 slide upward and a similar intermediate position is reached in which contacts 84 and 94 do not make with one of the other contacts. This feature allows the elimination of the shunt plugs and ensures that the horn 126 is activated upon the removal of plug 34 from jack 36.

The set-up and operation of the security system 10 will now be described. Key 40 is inserted into switch 38 and is turned to the SET position. The security system 10 is now in its set-up mode.

During the set-up mode, horn 126 is deactivated. Sensor 24 is attached to each item of merchandise 22 and sensor plug 34 is plugged into any one of the twelve mating jacks 36. Note that the order is not important and plug 34 may be inserted into jack 36 before sensor 24 is attached to the item 22. Similarly, the remaining items of merchandise are connected to the alarm circuit.

All sensors 24 which have their respective plugs 34 plugged into jacks 36 will have their corresponding LED 46 illuminate a first color (indicating a secure or non-alarm state), if the connections have been properly made and the sensor 24 is properly secured to the merchandise 22.

Each jack 36 may have an associated strip LED 44. In the preferred embodiment strip LEDs 44 are three terminal bi-color LEDs. However, other indicating means may be used. For every plug 34 inserted into a jack 36, its associated LED 44 will also illuminate a first color. During the set-up mode, if sensor 24 is improperly connected to the merchandise, both the sensor LED 46 and the corresponding strip LED 44 will illuminate a second color (red in the preferred embodiment) indicating an alarm or nonsecure condition. This indicates to store personnel that the sensors 24, sensor cord 28, plug 34 or jack 36 are improperly connected. In the set-up mode, the horn 126 is disconnected and does not sound even if a sensor 24 is improperly attached to the merchandise.

The colors of bi-colored LEDs 46, 44 are preferably green and red. The first color of an LED indicates a normal or non-alarm condition. It the preferred embodiment, the first color may be green. During a security breach, for example if the sensor 24 is tampered with, the bi-colored sensor LED 46 and the corresponding strip LED 44 will turn a second color, e.g., red. In the ON position, an alarm will sound during a security breach, alerting the store personnel. If the wire 28 is cut, no power goes to the sensor LED 46 and it is extinguished, however the strip LED 44 will turn red and the alarm will sound.

It should be noted that LEDs are not required on either the sensor or the strip. However, they assist the store personnel to more quickly determine the location of the security breach. Also, one skilled in the art could readily adapt the instant invention to use two-terminal bi-color LEDs, one color LEDs or similar indicating means on the sensors or on the strip. The embodiment using only one color LED, may use a first color (green) to indicate a secure state and an alarm condition is indicated when the LED is not illuminated.

Note that all twelve jacks 36 do not have to be connected to merchandise. The present invention is designed so that it does not require shunts on unused jacks 36 when less than twelve items are being protected.

After all sensors 24 are properly attached, all sensor LEDs 46 and strip LEDs 44 will illuminate the first color. The key switch 38 is then turned to the "ON" or armed position. In the ON position, all sensor LEDs 46 and all strip LEDs 44 will continue to indicate the first color. In the ON position, the horn 126 is now activated and will sound if there is a security breach.

After key switch 38 is turned to the ON position, the following conditions will exist:

1. The green LED 56 in the sensor will be on.
2. The voltage on the high side of the two wire sensor cable 28 (i.e., wire 30) with respect to the low side of the sensor cable (i.e., wire 32) will be approximately 2 volts. This is the forward voltage drop across the green LED 56 in the sensor 24. The sensor 24 gets its power through resistor 74 which is connected to the 9-volt supply voltage V1 through a PNP transistor 78 which is normally on.
3. The voltage on the high side of the sensor cable is two volts and it appears at the set input of the cross coupled NOR-gate latch 100 via its connection through slide switch 85. When the plug 34 is inserted into jack 36, as shown in FIG. 15B, contacts 83 and 84 of slide switch 85 are made. A 6.2 Megaohm resistor is connected between contact 84 and the supply voltage V1 and serves as a pull-up resistor for the input of the latch 100. A resistor 90 between the contact 84 of slide-switch 85 and the said input of latch 100 serves to protect the input of the latch from transient voltage spikes on the sensor cable.
4. The output of the latch 100 will be low.
5. The input of the true/complement buffer 106 is connected to the output of the latch 100. The true output 109 of the buffer 106 drives the anode of the red LED 110. The complement output 113 of the buffer 106 drives the anode of the green LED 111 through a non-inverting tri-state driver 112. With the input to the true complement buffer 106 low, the complement output 113 will be high, thereby forward biasing the green LED 111 which will light. The common cathode of the strip LED 44 is connected to ground through resistor 114. Resistor 114 is a one kilohm resistor which limits the LED current. Contact 94 and 93 of slide switch 116 make since the plug 34 is inserted into jack 36. Contact 91 of slide switch 116 is connected to the complement output 113 of the true complement buffer.

Removal of sensor cable plug 34 from jack 36 will cause sensor LED 46 to extinguish (red LED 54 and green LED 56 are both off), since the sensor is being disconnected from its power source inside the strip.

An alarm condition due to the removal of the sensor cable plug 34 from the jack 36 utilizes the double-pole double-throw slide switch 85, which is an integral part of jack 36. While plug 34 is being removed from jack 36 the elastically mounted contact 72 which is biased by spring 302 returns to its normal position as shown in FIG. 15A. As contact 72 moves, insulating portion 300 slides the metal arms 312 and 313 of switches 85 and 116 respectively. Accordingly, when the plug 34 is removed, terminal 84 makes with terminal 81 while terminal 94 makes with terminal 91; terminals 84 and 83 are no longer electrically connected nor are terminals 94 and 93.

As shown in FIG. 15C, the slide switches are a break-before-make type of switch and therefore common contact 84 is temporarily disconnected from terminals 83 and 81; similarly, common contact 94 is temporarily disconnected from terminals 93 and 91. At this point, resistor 88 pulls up the set input of the RS latch 100 thereby setting the output of latch 100 to be high. This high output level drives the true output 109 of the true/complement buffer 106 to high which forward biases the red LED 110 turning it on. The complement output 113 of the true/complement buffer will go low, thereby turning off the green LED 111 on the strip.

After plug 34 is fully removed, metal arm 312 makes an electrical connection between terminals 84 and 81 and metal arm 313 makes an electrical connection between terminals 94 and 91. Therefore, the current supply to the red LED 110 is sourced by the true output 109 of the true complement buffer 106 and is sinked by the complement output 113 of the buffer through resistor 114.

The high level at the output of the latch 100 will turn on the horn via OR gate 120 and the transistor 122. Note that if any one of the eight inputs to OR gate 120 goes high, the output of the OR gate will go high thereby turning on transistor 122 through base resistor 124 which in turn activates the horn 126. In a preferred embodiment, base resistor 124 is a two kilohm resistor.

The red LED 110 on the strip and the horn 126 will remain on, even if the sensor plug 34 is plugged back into jack 36 since the RS latch 100 remains in the set condition. Latch 100 is reset upon the activation of key switch 38 from the ON position to the SET position.

During a secure condition, sensor 24 is properly attached to an item of merchandise 22. Accordingly, actuator 48 is depressed, closing switch 50 and illuminating green LED 56. Upon the removal of sensor 24, switch 50 opens and the green LED 56 goes off. The power supplied to sensor 24 through resistor 74 in the strip will cause current to flow through the red LED 54 and resistor 52 in the sensor. The red LED 54 in the sensor will now illuminate. Simultaneously, a voltage equivalent to the sum of the forward voltage drop of the red LED 54 and the IR drop across resistor 52 will appear at the input 240 of the RS latch 100 via the sensor cable 28. This voltage will be greater than ⅔ of the V1 supply and will cause the RS latch 100 to set. The output of the latch 100 will go high causing the horn 126 to sound and the green LED 111 on the strip to turn off while the red LED 110 on the strip illuminates.

Reattaching the sensor to the merchandise 22 will not turn off the horn 126, nor will it turn off the red LED 110 on the strip. However, the red LED 54 on the sensor 24 will go off and the green LED 56 and the sensor 24 will go on.

If the sensor cord 28 is cut, the security system 10 will operate in a similar fashion as when sensor 24 is separated from merchandise 22. However, the sensor LED 46 will not light.

After a security breach, the security system must be reset. In order to turn off the horn 126 and to reset the latches 100, key switch 38 must be turned to the SET position, all sensor cable plugs 34 must be properly plugged into jacks 36 and all sensors 24 must be properly attached to the merchandise 22.

As one will note from FIG. 6, detector circuitry 33A, 33B and 33C; LED circuitry 35A, 35B and 35C; sampling circuitry 37; low battery detect circuitry 39; alarm circuitry 41 are all located within strip 12. Only sensor circuits 31A, 31B and 31C are located outside strip 12. Applicant's self-contained security device minimizes the number of external connections and eliminates splitter boxes and shunt plugs.

What is claimed is:

1. A security device for merchandise, comprising:

sensor means for attachment to merchandise, and two-wire connector means for electrically connecting said sensor means to an alarm circuit;

said alarm circuit having means for sending current via said two-wire connector means to said sensor means and back to said alarm circuit to display a secure mode signal, said alarm circuit further having means for sending current to an alarm means to sound an alarm and display an alarm mode signal, wherein said alarm circuit comprises switch means for switching said alarm circuit to an alarm mode when at least one of the following conditions occurs;

said two-wire connector means is cut or detached from at least one of a housing having said alarm circuit therein or from said sensor means; or said sensor means is detached from said merchandise; and a jack means on said housing, and plug means on said two-wire connector means said jack means and said plug means forming a means for electrically connecting said alarm circuit to said two-wire connector means, wherein said jack means comprises switch means moveable upon insertion or removal of said plug means from said jack means by moving from a first secure state to an interim alarm state and then to a second secure state, whereby current is prevented from flowing to generate said secure mode signal during said interim alarm state when said plug means is inserted or removed from said jack means.

2. The device of claim 1 wherein said secure mode signal is displayed on both said sensor means and said housing.

3. The device of claim 1 wherein said alarm mode signal is displayed on both said sensor means and said housing.

4. A security device for merchandise, comprising:

an alarm circuit in a housing, sensor means for attachment to merchandise, and two-wire connector means for electrically connecting said sensor means to said alarm circuit;

said alarm circuit having means for sending current via said two-wire connector means to said sensor means and back to said alarm circuit to display a secure mode signal, said alarm circuit further having means for sending current to an alarm means to sound an alarm and display an alarm mode signal, an AC power supply means for operating said device, a battery means connected to said alarm circuit for supplying power to said device when said AC power supply means is unavailable, an energy conservation means having deactivation circuit means for disabling said secure mode signal during operation of said battery means and a pulsing circuit means for sending an electrical pulse; and drive means for sending current when said electrical pulse is prevented from flowing.

5. The device of claim 4 wherein the pulsing circuit means provides an electrical pulse of about 100 microseconds once every period of about 400 milliseconds.

6. The device of claim 4 wherein said secure mode signal and said alarm mode signal are displayed via a bi-color LED on said sensor and a second bi-color LED on said housing.

7. The device of claim 4 wherein said secure mode signal and said alarm mode signal are displayed via a bi-color LED on said sensor means.

8. The device of claim 4 wherein said secure mode signal and said alarm mode signal are displayed via a bi-color LED on said housing.

9. A security device for merchandise, comprising:

an alarm circuit within a housing, sensor means for attachment to merchandise and two-wire connector means for electrically connecting said sensor means to said alarm circuit;

said alarm circuit having means for sending current via said two-wire connector means to said sensor means and back to said alarm circuit to display a secure signal mode from a bi-color LED, said alarm circuit further having means for sending current to an alarm means to sound an alarm and display an alarm mode signal from a bi-color LED, said alarm circuit having switch means for switching said alarm circuit to an alarm mode when at least one of the following conditions occurs;

said two-wire connector means is cut or detached from either said housing or said sensor means; or said sensor means is detached from said merchandise; and a jack means on said housing and plug means on said two-wire connector means, said jack means and said plug means forming a means for electrically connecting said alarm circuit to said two-wire connector means, said jack means having switch means moveable upon insertion or removal of said plug means from said jack means by moving from a first secure state to an interim alarm state and then to a second secure state, whereby current is prevented from flowing to generate said secure mode signal during said interim alarm state when said plug means is inserted or removed from said jack means.

10. The device of claim 9 wherein said secure mode signal is displayed on both said sensor means and said housing.

11. The device of claim 9 wherein said alarm mode signal is displayed on both said sensor means and said housing.

12. The device of claim 9 which further comprises:

AC power supply means for operating said device;

battery means connected to said alarm circuit for supplying power to said device when said AC power supply means is unavailable;

energy conservation means having deactivation circuit means for disabling said secure mode signal during operation of said battery means and a pulsing circuit means for sending an electrical pulse; and drive means for sending current when said electrical pulse is prevented from flowing.

13. The device of claim 12 wherein the pulsing circuit provides an electrical pulse of about 100 microseconds once every period of about 400 milliseconds.

14. The device of claim 9 wherein said secure mode signal and said alarm mode signal are displayed via a bi-color LED on said sensor means and a second bi-color LED on said housing.

* * * * *